US009707426B2

(12) United States Patent
Tsai

(10) Patent No.: US 9,707,426 B2
(45) Date of Patent: Jul. 18, 2017

(54) BOUNDING TABLE AND THE INSTALLATION TOOL OF THE BOUNDING TABLE

(71) Applicant: Guangan Zeng, Shenzhen (CN)

(72) Inventor: Mo-Tsan Tsai, Shenzhen (CN)

(73) Assignee: KE M.O. HOUSE CO., LTD, Shenzhen (CN)

( * ) Notice: Subject to any disclaimer, the term of this patent is extended or adjusted under 35 U.S.C. 154(b) by 0 days.

(21) Appl. No.: 14/687,656

(22) Filed: Apr. 15, 2015

(65) Prior Publication Data

US 2016/0256722 A1 Sep. 8, 2016

(30) Foreign Application Priority Data

Mar. 6, 2015 (CN) ..... 2015 2 0130629 U

(51) Int. Cl.
*A63B 5/11* (2006.01)
*A63B 21/055* (2006.01)

(52) U.S. Cl.
CPC ..... *A63B 5/11* (2013.01); *A63B 21/0552* (2013.01)

(58) Field of Classification Search
CPC ... A63B 5/11; A63B 2210/50; A63B 21/0552; A63B 71/0054; A63B 2071/009; A63B 2071/0063; A63B 2071/0694; A63B 21/026; A63B 5/16; A63B 6/02; A63B 2208/0204; A63B 5/00; A63B 69/0064; A63B 21/4037; A63B 21/02
USPC ..... 482/23, 25–32
See application file for complete search history.

(56) References Cited

U.S. PATENT DOCUMENTS 2,991,841 A * 7/1961 Sampson ..... A63B 5/11 482/27
4,331,329 A * 5/1982 Mirkovich ..... A63B 5/11 482/27
5,299,989 A * 4/1994 Boyd ..... A63B 5/11 182/139
D363,325 S * 10/1995 Wilkinson ..... D21/797
5,634,870 A * 6/1997 Wilkinson ..... A63B 5/11 482/27
5,645,510 A * 7/1997 Wilkinson ..... A63B 5/11 482/27
5,788,608 A * 8/1998 Wilkinson ..... A63B 21/0724 482/51
5,967,943 A * 10/1999 Rich ..... A63B 5/11 182/37

(Continued)

*Primary Examiner* — Andrew S Lo
(74) *Attorney, Agent, or Firm* — Shimokaji IP

(57) ABSTRACT

The present disclosure provides a bounding table which includes a supporting frame, a jumping mat and a plurality of elastic ropes; the supporting frame is annular, the elastic rope includes a bungee cord and a connecting ball, the bungee cord is bent and both ends of the bungee cord are tied together in a knot, so that the bungee cord forms a lantern ring; the knotting bungee cord passes through the through hole of connecting ball; the knotting bungee cord bifilarly passes through the ring of the jumping mat and hitches the supporting frame. The elastic ropes connect the jumping mat with the rings of the jumping mat. Moreover, the supporting frame includes a plurality of side rods connected head to tail in sequence, each side rod is welded with standing leg; the bounding table includes a single rob armrest frame, the height of the armrest is adjustable.

9 Claims, 8 Drawing Sheets

(56) References Cited

U.S. PATENT DOCUMENTS

| | | | | |
|---|---|---|---|---|
| 6,129,649 | A * | 10/2000 | Yang | A63B 5/11 482/27 |
| 6,599,221 | B1 * | 7/2003 | Goldwitz | A63B 5/11 482/27 |
| 7,794,360 | B2 * | 9/2010 | Publicover | A63B 5/11 482/27 |
| D661,360 | S * | 6/2012 | Campanaro | D21/797 |
| D742,467 | S * | 11/2015 | Giorgi | D21/797 |
| 9,314,389 | B2 * | 4/2016 | Richter | A61G 13/009 |
| D758,515 | S * | 6/2016 | Tsai | D21/797 |
| 2005/0107217 | A1 * | 5/2005 | Chen | A63B 5/11 482/27 |
| 2006/0135321 | A1 * | 6/2006 | Chen | A63B 5/11 482/27 |
| 2006/0172861 | A1 * | 8/2006 | Wang | A63B 5/11 482/27 |
| 2010/0009812 | A1 * | 1/2010 | Pieper Genannt Schmauck | A63B 5/11 482/27 |
| 2010/0075810 | A1 * | 3/2010 | Schaffer | A63B 5/11 482/27 |
| 2013/0210590 | A1 * | 8/2013 | Publicover | A63B 5/11 482/110 |
| 2013/0316876 | A1 * | 11/2013 | Publicover | A63B 5/11 482/27 |
| 2014/0066259 | A1 * | 3/2014 | Andon | A63B 5/11 482/27 |
| 2014/0066260 | A1 * | 3/2014 | Liu | A63B 5/11 482/27 |
| 2015/0080186 | A1 * | 3/2015 | Carlin | A63B 5/11 482/27 |
| 2016/0096056 | A1 * | 4/2016 | de Boer | A63B 5/11 482/27 |

* cited by examiner

BOUNDING TABLE AND THE INSTALLATION TOOL OF THE BOUNDING TABLE

CROSS-REFERENCE TO RELATED APPLICATIONS

This application claims the benefit of priority to Chinese Patent Application NO. 201520130629.8 filed in Chinese Patent Office on Mar. 6, 2015 and entitled "BOUNDING TABLE AND THE INSTALLATION TOOL OF THE BOUNDING TABLE", the content of which is hereby incorporated by reference in its entirety for all intended purposes.

FIELD

The present application relates to the field of sports apparatus, and particularly to a bounding table and an installation tool of the bounding table.

BACKGROUND

Nowadays, a bounding table usually includes a supporting frame and a jumping mat, and the supporting frame and the jumping mat are connected by a plurality of springs. However, in order to firm the connections between the supporting frame, the jumping mat and the springs, complex structures are needed to be designed to realize the connections among the supporting frame, the jumping mat and the springs. Therefore, it is quite difficult to manufacture and install the bounding table. In addition, since the hardness of the spring is relatively larger, if a user falls on the springs accidentally, there will be large impact on the user even if a cushion is put on the springs, thereby lacking of security.

SUMMARY

The present application provides a bounding table and an installation tool for the bounding table. The bounding table has a simple structure and higher safety, and is easy to assemble. The installation tool is used to install the bounding table.

The present disclosure provides a bounding table. The bounding table includes a supporting frame, a jumping mat and a plurality of elastic ropes; wherein the support frame is annular, and the jumping mat is located at the center of the support frame, and the periphery of the jump mat is connected to the support frame by the elastic ropes;

the jumping mat includes a plurality of rings, and the rings are evenly arranged along the periphery of the jumping mat;

each elastic rope includes a bungee cord and a connecting ball, wherein the bungee cord is bent and both ends of the bungee cord are tied together in a knot, so that the bungee cord forms a lantern ring; the connecting ball defines a through hole, the bungee cord bifilarly passes through the through hole and the connecting ball is limited at the knot of the bungee cord;

the bungee cord bifilarly passes through the ring of the jumping mat and is connected to the supporting frame, the bungee cord is connected between the supporting frame and the ring and is tensed.

Wherein the bungee cord hitches around the supporting frame, and the lantern ring formed by the bungee cord hooks the connecting ball; or the supporting frame passes through the lantern ring formed by the bungee cord.

Wherein the knot of the bungee cord is located in the through hole of the connecting ball, a flange used to confine the knot in the through hole is on an inner wall of the through hole; the flange is an annulus along circumferential direction of the through hole.

Wherein the bungee cord is made from natural rubber.

Wherein the supporting frame includes a plurality of side rods which are connected head to tail in sequence to form a ring structure, and the bungee cords hitch on the side rods; each side rod is an arc-shaped section and is formed by bending a circular tube, and ends of two adjacent side rods are joined to each other and are fixed by a bolt.

Wherein the supporting frame is equipped with a plurality of standing legs which are arranged along the circumferential direction of the supporting frame; each standing leg is arranged perpendicularly relative to the supporting frame, and top of the standing leg is welded to the supporting frame.

The standing leg and the side rod are welded together correspondingly, and there is a one-to-one correspondence between the standing legs and the side rods.

Wherein the bounding table further includes a single-pole armrest frame, which includes a stand pipe, a regulating rod, an armrest and a lock screw; the stand pipe and the supporting frame are fixedly connected together; the top of the regulating rod and the armrest are fixed connected, and the regulating rod is adjustably located inside the stand pipe in order to adjust the height of the armrest; the lock screw penetrates the inner wall of the stand pipe through a threaded hole, and one end of the lock screw connects the regulating rod to fasten the relative positions between the regulating rod and the stand pipe.

Wherein the top of the regulating rod bends towards the inner side of the supporting frame.

In addition, the present application also provides an installation tool, used to install the bounding table, including two installation rods placed in parallel; and there is a gap between the two installation rods, two adjacent ends of the installation rods in parallel connect together, and the other two adjacent ends of the installation rods bend to form two hooks; there is a gap between the two hooks.

According to the described bounding table, the elastic ropes can easily connect with the jumping mat through the rings arranged along the periphery of the jumping mat; the bungee cord can provides elasticity between the jumping mat and the supporting frame, and the bungee cord is bent and both ends of the bungee cord are tied together in a knot, so that the bungee cord forms a lantern ring, therefore the elastic ropes can also connect with the supporting frame easily without other connecting structure setting on the supporting frame, wherein the elastic rope is flexible, high security.

According to the described installation tool, used to install the bounding table, using the gap between the two installing rods to open a space in the lantern ring of bungee cord so that the connecting ball can easily slid in the ring; the hooks can be used to hook on the side rod and also be used to clamp connecting ball so that the connecting ball gets through the ring of bungee cord and the bungee cord hook connecting ball up; the installation tool makes installation of the bounding table convenient.

BRIEF DESCRIPTION OF THE DRAWINGS

In order to illustrate the technical solutions of this application more clearly, a brief description of drawings that assists the description of embodiments will be provided below. It would be apparent that the drawings in the following description are only for some of the embodiments of the disclosure. A person having ordinary skills in the art will be able to obtain other drawings on the basis of these drawings without paying any creative work.

DETAILED DESCRIPTION OF ILLUSTRATED EMBODIMENTS

Further descriptions of present disclosure will be illustrated clearly and completely, which can be combined with embodiments in drawings and detailed embodiments.

Obviously, the embodiments here are not all embodiments but only part of embodiments of present disclosure. Based on the embodiments of present disclosure, under premise of without paying out creative work, other embodiments obtained by the person having ordinary skill in the art are considered to be encompassed within the scope of the present disclosure.

Please refer to FIG. 1 to FIG. 7 together, a bounding table according to one embodiment is provided by the present disclosure includes a supporting frame 1, a jumping mat 2 and a plurality of elastic ropes 3. The supporting frame 1 is annular. The jumping mat 2 is located at the center of the supporting frame 1. In addition, the periphery of the jumping mat 2 is connected to the supporting frame 1 through the plurality of elastic ropes 3. In actual use, when a user jumps on the jumping mat 2, the elastic ropes 3 can provide elastic force for the user, so as to increase jumping amplitude to the user.

Figure 1:
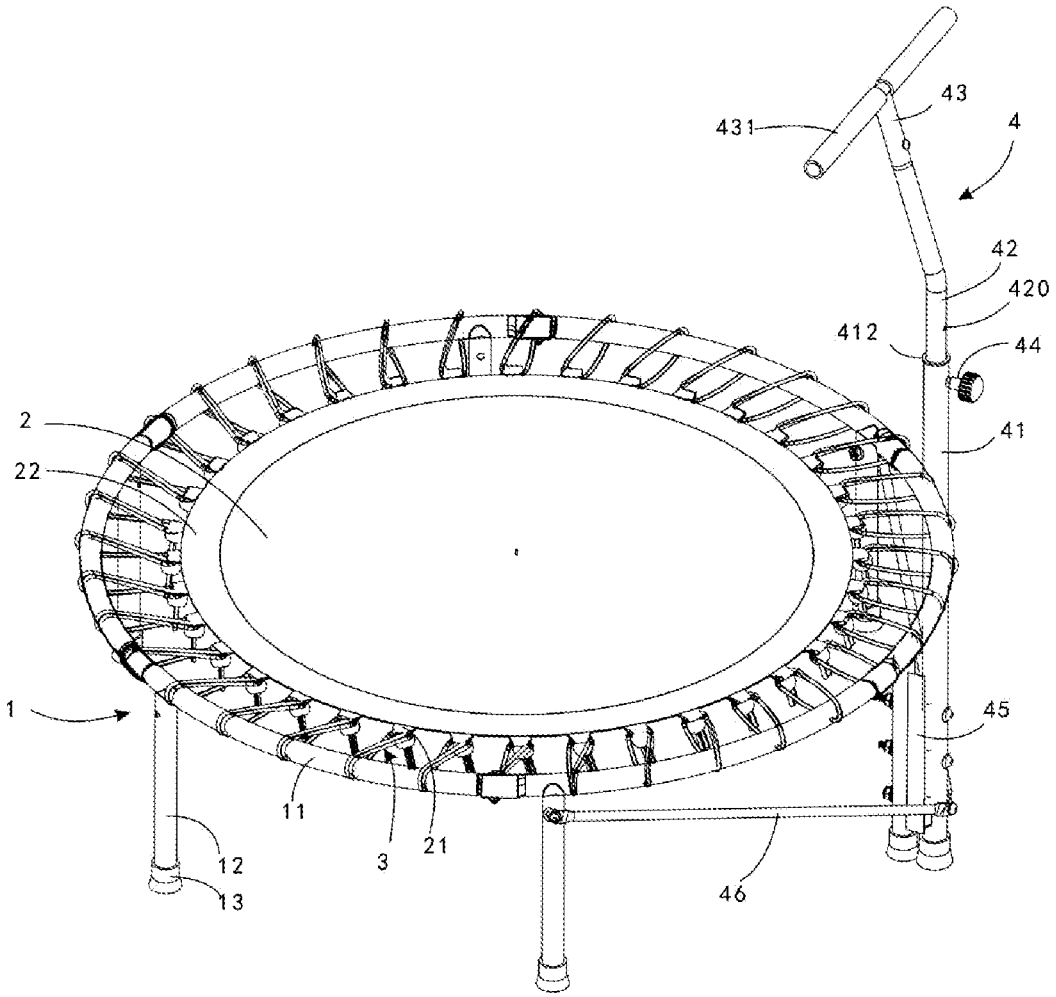
FIG. 1 is a structure diagram of a bounding table according to one embodiment of the present disclosure.
Figure 2:
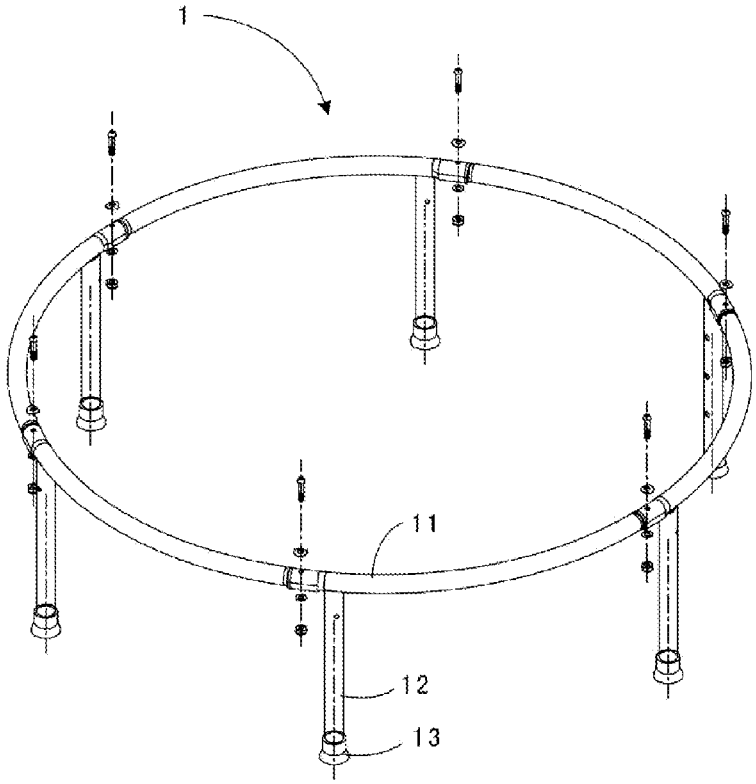
FIG. 2 is a structure diagram of a supporting frame of the bounding table as shown in FIG. 1.

Referring to FIG. 1 and FIG. 2, according to the embodiment of the present disclosure, the supporting frame 1 includes a plurality of side rods 11 and the plurality of side rods 11 are connected head to tail in sequence to form a ring structure; the elastic ropes 3 are connected to the side rods 11, for example, the elastic ropes 3 can connect the side rods 11 by means of hitching the side rods 11. More specifically, the number of the side rods 11 is six, but not limited to six understandably, in other embodiments, the number of the side rods 11 can be three, four or any other numbers. The supporting frame 1 is annular. Each side rod 11 as a part of the supporting frame 1 is an arc-shaped section, so that all the side rods 11 are connected in series to form an annulus.

Each side rod 11 is an arc-shaped section and can be formed by bending a circular tube; ends of two adjacent side rods 11 are joined to each other and are fixed by a bolt, that is, one end of a side rod 11 is inserted into one end of an adjacent side rod 11 to form a joint, and the joint between any two adjacent side rods 11 are fixed by a bolt. It should be noted that each side rod 11 is a tubular structure, and the tubular structure of the side rod 11 can improve the structural strength of the supporting frame 1 and is convenient for connection and assembly of the side rods 11.

The supporting frame 1 is equipped with a plurality of standing legs 12 which are arranged along the circumferential direction of the supporting frame 1; each standing leg 12, top of which is connected to the supporting frame 1 by such as welding, is arranged perpendicularly relative to the supporting frame 1. The standing legs 12 are used to support the side rods 11 to a certain height relative to the ground, to ensure normal operation of the jumping mat 2 with dipping and heaving, but without touching the ground. Welding connection can enhance the connection strength between the side rods 11 and the standing legs 12, and further improve the stability of supporting frame 1 and the bounding table. In addition, the standing leg 12 and the side rod 11 are welded together correspondingly, that is, there is a one-to-one correspondence between the standing legs 12 and the side rods 11. In other word, the number of the standing legs 12 is equal to the number of the side rods 11. For example, the number of standing legs 12 is also six, and the six standing legs 12 are respectively welded to the six side rods 11. It should be noted that one-to-one correspondence between the standing legs 12 and the side rods 11 can simplify the structure of the bounding table and meet the load bearing strength, thereby effectively improve the stability of the bounding table. In other embodiments of present disclosure, there may be two or more standing legs 12 welded to one side rod 11; or only part of the side rods 11 is welded with the standing legs 12 and the rest of the side rods 11 is not welded with the standing legs 12.

Top of the standing leg 12 is welded to one end of the side rod 11. Since the side rod 11 is a circular arc and one end of side rod 11 is welded with a stand leg 11, so when the bounding table is detached, the side rod 11 and standing leg 12 as a whole are convenient for storage. In other feasible embodiments, top of the standing leg 12 can also be welded to the middle position or any other positions of the side rod 11. Bottom of the standing leg 12 can be equipped with a rubber pad 13 to avoid the friction of the bottom of the standing leg 12 and damage to the ground. Preferably, the standing leg 12 also can be a tubular structure.

In the embodiment of present disclosure, each supporting leg 12 is joined to a side rod 11 as a whole to form a supporting element, such that six supporting legs 12 and six side rods 11 are connected together respectively to form six supporting elements. All the supporting elements have exactly the same structure, which can make the assembly of the supporting elements convenient. The supporting frame 1 is divided into several supporting elements, which is beneficial to decreasing the volume of the supporting frame 1 and facilitating packing of the supporting frame 1 before assembly.

Referring to FIG. 1, the periphery of the jumping mat 2 has a plurality of rings 21 which are evenly arranged along the periphery of the jumping mat 2. According to the embodiment of the present disclosure, each ring 21 can be formed by bending a fabric strap and is sewed to the periphery of the jumping mat 2, to connect the ring 21 to the jumping mat 2 firmly. Furthermore, there is a reinforcing band 22 on the jumping mat 2, and the reinforcing band 22 is an annulus and is arranged alone the periphery of the jumping mat 2 and is sewed to jumping mat 2; one end of the fabric strap is clamped between the jumping mat 2 and the reinforcing band 22, which can further enhance the connection structure and connection strength. The ring 21 can be made of high strength nylon to increase the structure strength of the ring 21.

Figure 3:
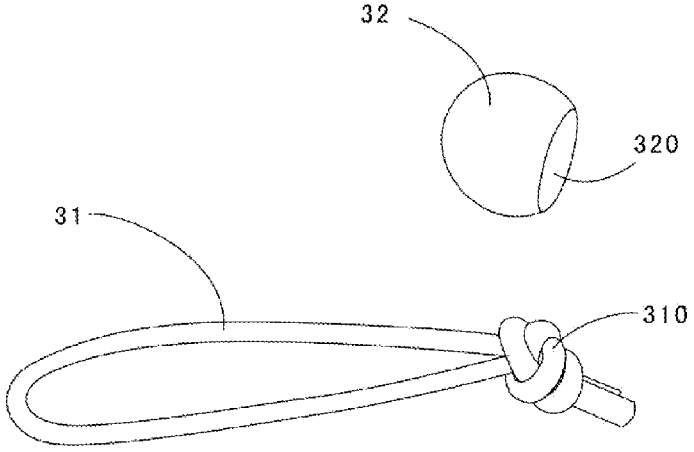
FIG. 3 is an exploded view of an elastic rope of the bounding table in FIG. 1.
Figure 4:
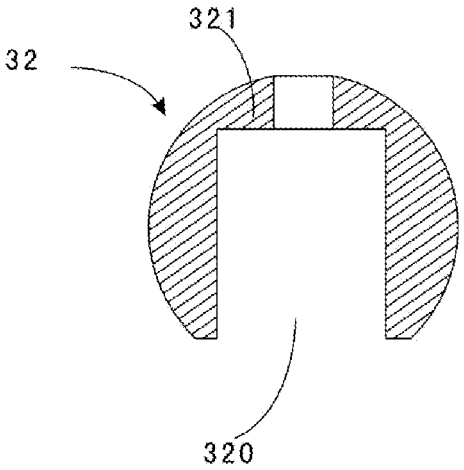
FIG. 4 is a cross-section view of connecting ball of the elastic rope of FIG. 3.
Figure 5:
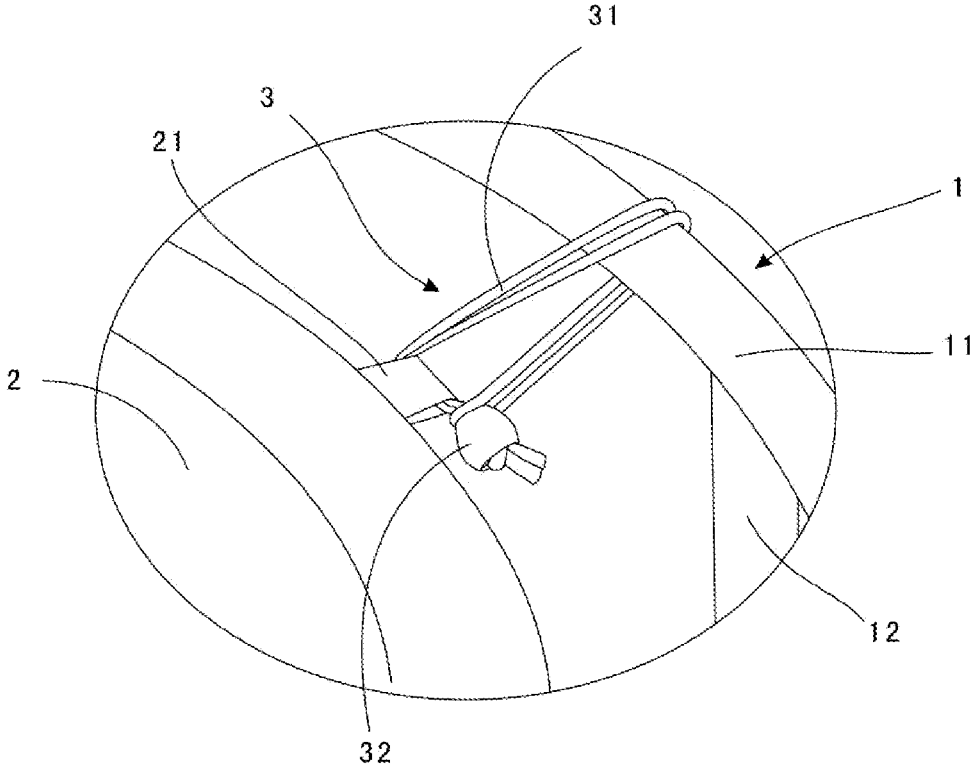
FIG. 5 is a schematic diagram of a connection among the elastic ropes, the supporting frame and a jumping mat of bounding table in FIG. 1.

Referring to FIG. 3 to FIG. 5, each elastic rope 3 includes a bungee cord 31 and a connecting ball 32, and the bungee cord 31 is bent and both ends of the bungee cord 31 are tied together in a knot 310, so that the bungee cord 31 becomes an annulus. Preferably, the bungee cord 31 is made of natural robber with good elasticity, high strength, long service life and good overall performance. The connecting ball 32 defines a through hole 320, and the bungee cord 31 bifilarly passes through the through hole 320, so that the connecting ball 32 is limited and stops at the knot 310.

According to the embodiment of present disclosure, the knot 310 is located in the through hole 320. A flange 321 is on an inner wall of the through hole 320, the flange 321 is an annulus along the circumferential direction of the through hole 320, in order to block the knot 310 in the through hole 320. The flange 321 limits and stops the connecting ball at the knot 310 and prevents the knot 310 falls off the through hole 320. The knot 310 is located in the through hole 320, that is, the knot 310 is collected by the through hole 320, therefore the through hole 320 can completely hide the knot 310 from the outside to make the structure of elastic rope 3 more concise and pleasing to the eye. Furthermore, the knot 310 and through hole 320 can be interference fit so that the knot 310 can be tightly squeezed in the through hole 320 to prevent the knot 310 falling off the through hole 320 and to make the connection between the knot 310 and the connecting ball 32 more stable and reliable. In other embodiments of present invention, the external dimension of knot 310 can be greater than the diameter of through hole 320, so that the knot 310 can be entirely keep outside the through hole 320 and the connecting ball 32 is limited and stopped next to knot 310 when the bungee cord 31 passes through the through hole 320. The bungee cord 31 and the through hole 320 can be interference fit to increase the firmness of connection between the elastic 31 and the connecting ball; or perhaps, the through hole 320 is a taper hole in which the diameter of one end is greater than the diameter of the other end, the elastic rope 31 can pass the through hole 320 from the greater diameter end, which make connection between the connecting ball 32 and the bungee cord 31 convenient and collect the knot 310 in the connecting ball 32.

Referring to FIG. 5, the elastic 31 bifilarly passes through the ring 21 and entangles the supporting frame 1, and the bungee cord 31 tenses between the supporting frame 1 and the ring 21. According to the embodiment of this disclosure, the bungee cord 31 bifilarly set around the side rod 11 of the supporting frame 1, and the lantern ring formed by the bungee cord 31 hooks on the connecting ball 32, that the elastic rope 3 is bifilarly hitching on the supporting frame 1 that the side rod 11 of supporting frame 1 wears the bifilar lantern ring of the elastic rope 3. The bungee cord 31 in four-ply shape also can connect the supporting frame 1 and jumping mat 2, which can effectively increases elasticity between the supporting frame 1 and the jumping mat 2. In other feasible embodiments, it is possible that the side rod 11 of the supporting frame 1 passes through the lantern ring formed by the bungee cord 31, that is the bungee cord 31 directly hitches around the side rod 11 of supporting frame 1 in single-ply shape and the connecting ball 32 is blocked outside one end of ring 21 to prevent the elastic rope 3 falling off the ring 21. Under that condition, bifilar bungee cord 31 can be used between the supporting frame 1 and the jumping mat 2.

The elastic rope 3 can easily joint jumping mat 2 using the rings 21 arranged along the periphery of the jumping mat 2; the bungee cord 31 of the elastic rope 3 is capable to supply elasticity to the connection between the jumping mat 2 and the supporting frame 1, and the bungee cord 31 is bent and the both ends of the bungee cord 31 are tied together in a knot, so that the bungee cord 31 forms a lantern ring that easily achieves the connection of supporting frame 1 and elastic rope 3 without other connecting structure setting on the supporting frame 1. The connection structure of the supporting frame 1 and the elastic rope 3 is simple, and the elastic rope 3 has certain flexibility thereby high security.

Figure 6:
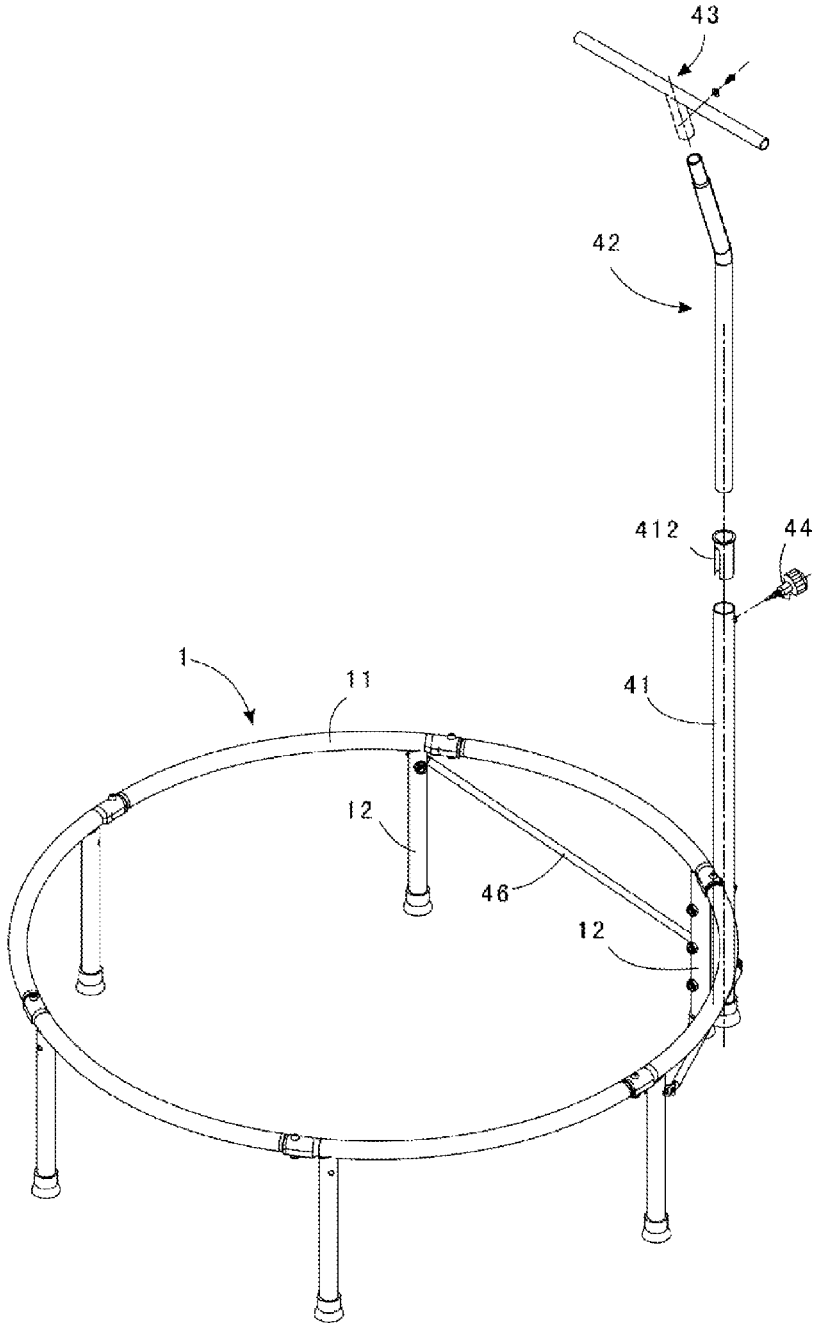
FIG. 6 is an exploded view of the supporting frame and the armrest frame of bounding table in FIG. 1.

Furthermore, referring to FIG. 6, the bounding table further includes a single-pole armrest frame 4, and the single-pole armrest frame 4 includes a stand pipe 41, a regulating rod 42, an armrest 43 and a lock screw 44. The stand pipe 41 and the supporting frame 1 are fixedly connected. The top of the regulating rod 42 and the armrest 43 are fixedly connected, and the regulating rod 42 is adjustably located inside the stand pipe 41 in order to adjust the height of the armrest 43. The lock screw 44 passes through the threaded hole in the stand pipe 41, and one end of the lock screw 44 connects the regulating rod 42 to fasten the relative position between the regulating rod and the stand pipe. Rotating the lock screw 44 to make it move alone the axis direction of the stand pipe 41, can coordinate the connection between one side of the lock screw 44 and the regulating rod 42. It is feasible to define through holes on the stand pipe 41 and to weld screw nuts on the stand pipe 41, so that the lock screws 44 pass through the stand pipe 41 and are locked with the screw nuts. Understandably, in other embodiments, it is also possible that threaded holes are opened on the stand pipe 41 and the lock screws 44 get through the threaded holes with thread.

The regulating rod 42 is tubular, on which there are several location holes 420, several location holes 420 is assigned along the axis of the regulating pipe 42, the inside end of lock screw 44 can get through inside the location hole 420. When the lock screw rotates outside to separate the inside end of lock screw 44 from stand pipe 41, the regulating rob 42 can move up and down; when the lock screw 44 rotates inside to get through inside the location hole 420, the regulating rob 42 and stand pipe are kept in place. According to yet another embodiment, no location hole 420 is set along the axis direction of the regulating pipe 42, the inside end of the lock screw 44 can pushes against the regulating rob 42 to lock the regulating rob 42 inside stand pipe 41 so that to fasten the relative position between stand pipe 41 and regulating rob 42.

A damper bushing 412 is set between the regulating rob 42 and the stand pipe 41 to prevent abrasion caused by friction between the regulating rob 42 and the stand pipe 41. The top of regulating rob 42 bends towards the inner side of the supporting frame 1, that the armrest 43 can stretches to the inner side of supporting frame 1. It is convenient for users to hold on the armrest while jumping on the bounding table. The armrest 43 is able to improve the sense of safety of users when jumping on the bounding table. According to the embodiment, the armrest 43 is T-shaped, that the user holds armrest 43 with both hands. The armrest has robber sleeve 431 on, to provide the sense of comfort for the user when holding the armrest.

According to the embodiment of this invention, only one stand pipe 41 and one regulating rob 42 supports the armrest 43, the structure of the singe-pole armrest frame 4 is simple and easy to be assembled. The armrest 43 is capable to make the center of gravity of user more stable when jumping and increase the sense of security of the user. The regulating rob 42 can be regulated up and down and the armrest 43 can be adjusted to a suitable height to adapt to different height person.

Figure 7:
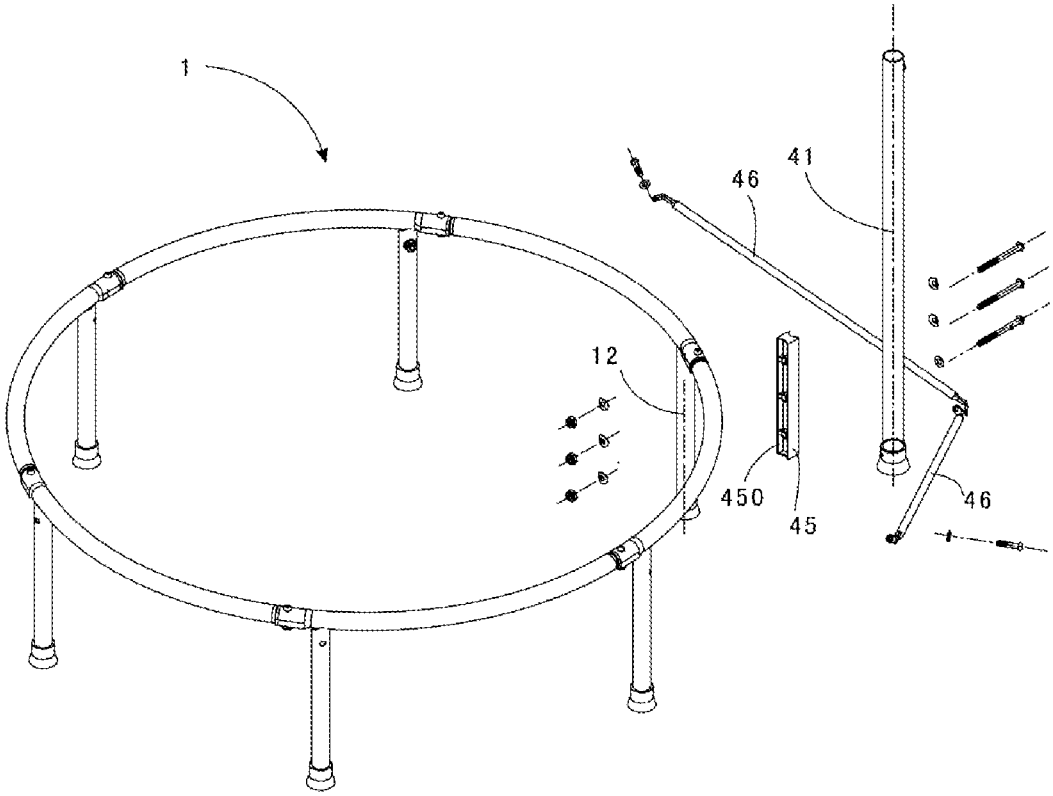
FIG. 7 is a schematic diagram of a connection between the supporting frame and a stand pipe in FIG. 6.

Referring to FIG. 7, the stand pipe 41 is fixed connected to standing leg 12 with interval piece 45. The interval piece is between the stand pipe 41 and the standing leg 12 and is a vertical strip. There are two installation grooves 450 setting on the interval piece. The two installation grooves 450 are adapt to stand pipe 41 and standing leg 12 separately. For the stand pipe 41 and standing leg 12 are all tubular in the embodiment, the installation groove 450 is made to concave-shaped that the interval piece 45 is better coordinated to stand pipe 41 and standing leg 12. The lock screw can pass through the stand pipe 41, the interval piece 45 and the standing leg 12 one by one to connect the three solidly.

There also is pull robs 46 between the stand pipe 41 and two other adjacent standing legs 12, the pull rob 46 is capable to still further increase the connection strength between the armrest frame 4 and the supporting frame 1.

The bounding table further includes safety pad which is not illustrated in the figures; the safety pad is set between the jumping mat 2 and the side rods and is put on the elastic rope 3. The safety pad can cover the gap between the jumping mat 2 and the side rods to avoid the user to fall on the elastic rope 3 when jumping and to guarantee the safety of the user.

In order to illustrate the assembly method for the jumping mat 2, the elastic rope 3 and the side rod 11, a detailed description will be provided below.

Figure 8:
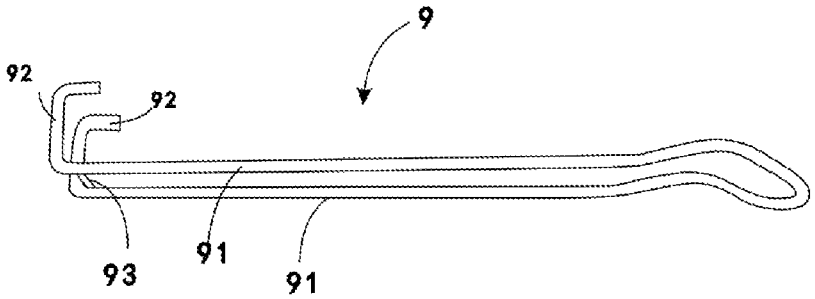
FIG. 8 is a schematic diagram of an assembly tool according to one embodiment of the present disclosure.
Figure 9:
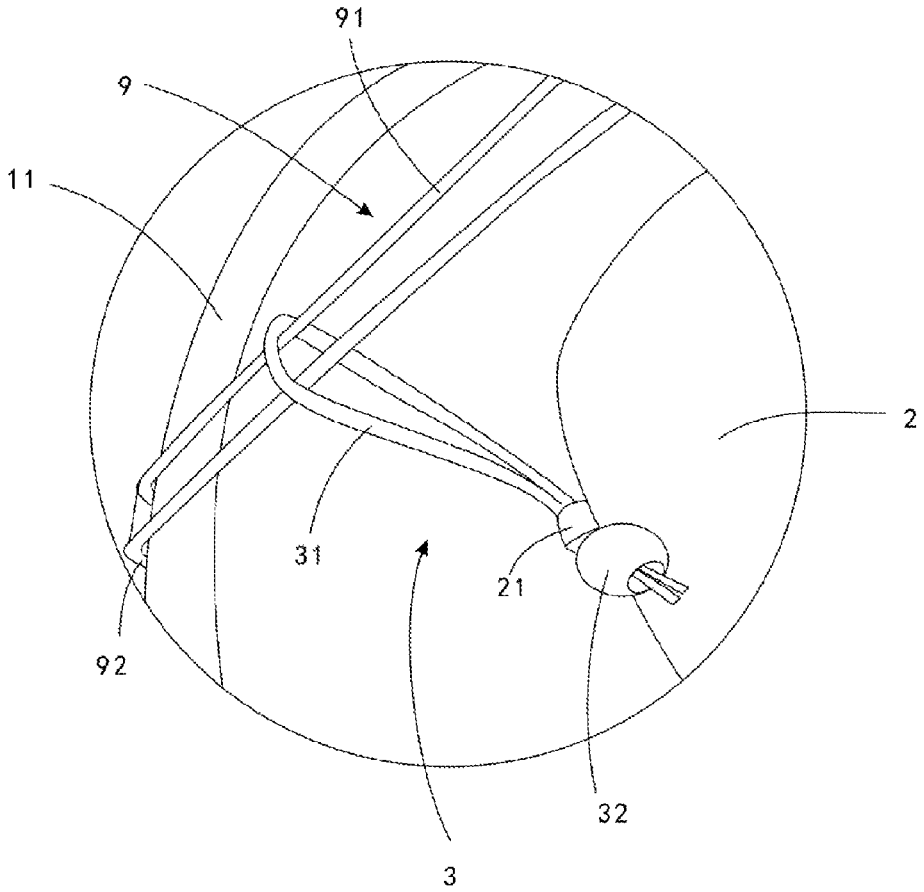
FIGS. 9 to 11 are process diagrams of assembling the bounding table using the assembly tool.
Figure 10:
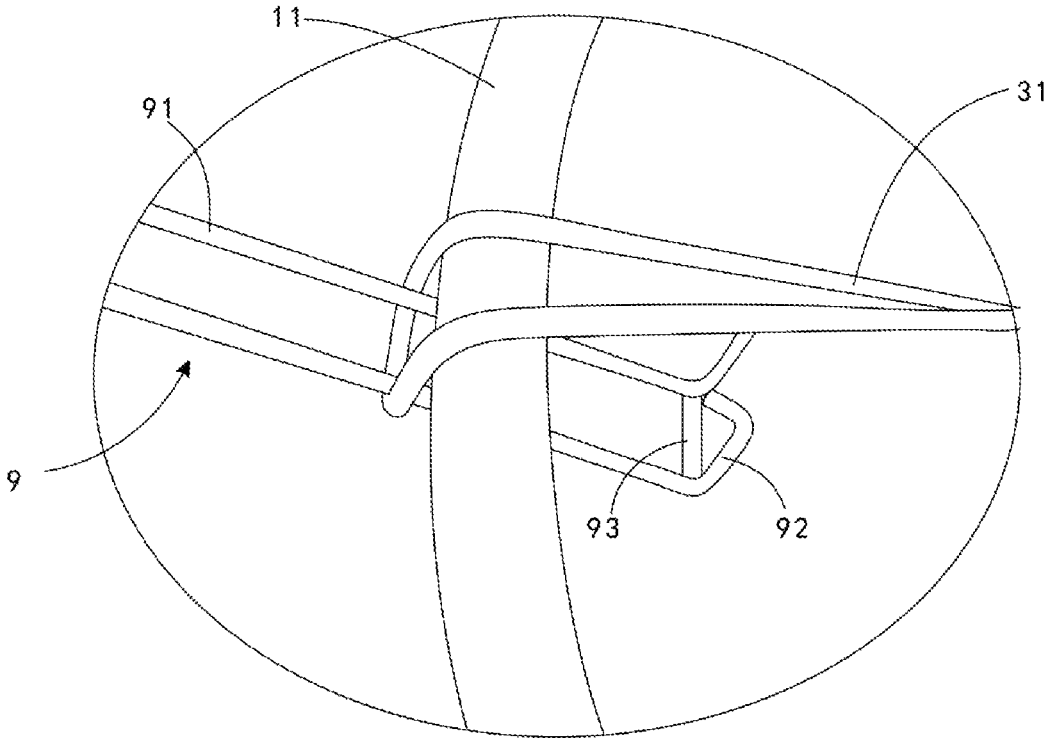
Figure 11:
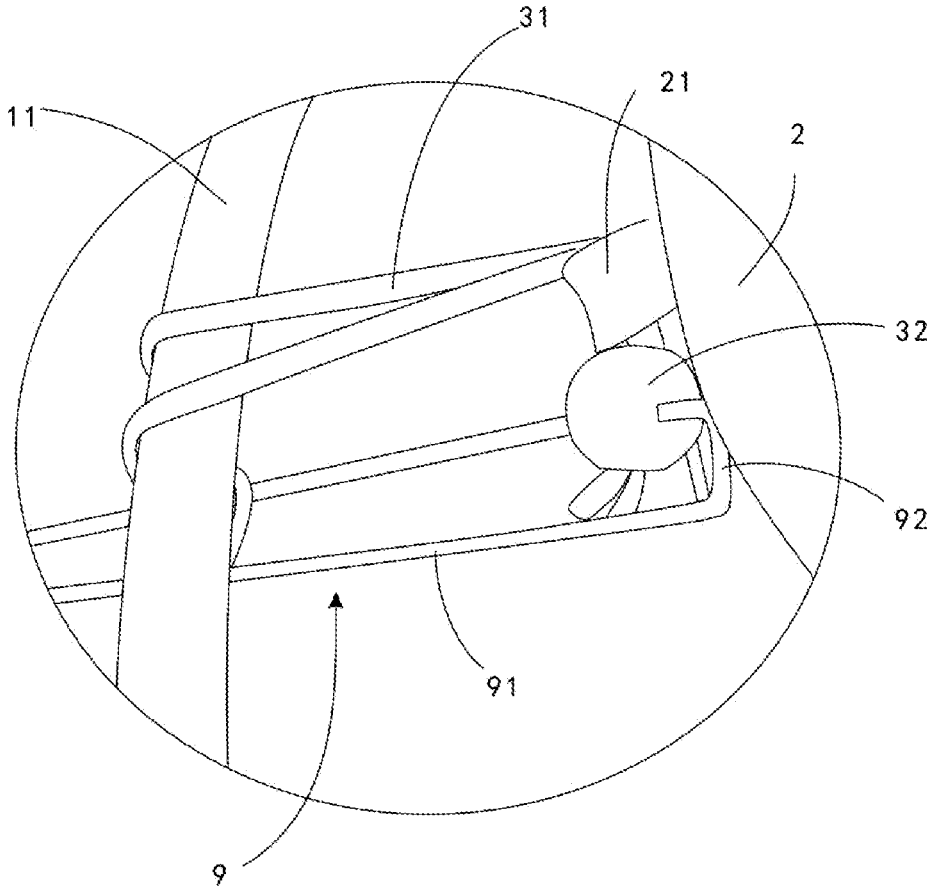

Referring to FIG. 8, according to FIG. 8, in order to facilitate the installation for the jumping mat 2, the elastic rope 2 and the side rod 11, the embodiment of present application provides an installation tool 9 in addition. The installation tool can be sold together with the bounding table as a part of the bounding table, in other word, the bounding table includes the installation tool 9. The installation tool is also can be packed and sold as an individual component. The installation tool 9 is long strip-shaped, and it includes two paralleled installation rod 91. There is a gap between the two installation rod 91. With the help of gap between two installation rod 91, the lantern ring formed by the bungee cord 31 can be stretched to a space, so that connecting ball can slide in the lantern ring formed by the bungee cord easily. Two adjacent ends of the installation rods 91 in parallel connect together fixedly, and the other two adjacent ends bend to form two hooks 92, and there is a gap between the two hooks 92. To be optimized, two installation rods 91 are integral formed, that is, the two installation rod 91 are made from a metal bar bending to U shape, the structure will improve the strength of the two installation rods 91. When installing the bounding table, on the one hand, the two installation rods 91 are capable to hook on the side rod 11, on the other hand, the two installation rods 91 can set on the two side of the connection ball 32 to clamp the connecting ball 32, that the connecting ball 32 gets through the lantern ring formed by the bungee cord and hooks on the bungee cord. Furthermore, there is a fixed link 93 on one side of two installation rods 91 with hooks 92, the fixed link 93 can improve the structure strength of the two hooks.

When assembling the jumping mat 2, the elastic rope 3 and the side rod 11 together, firstly, making the bungee cord 31 bifilarly get through the ring 21 and the connecting ball 32 keep at one side of ring 21, then making the end of the assembling tool 9 with hook 92 get through the lantern ring formed by the bungee cord 31 to hook the edge of the side rod from the upside. Secondly, rotating the assembling tool 9, the side rod as center, to outside of the side rod 11, so that the assembling tool 9 goes down below the side rod; and pushing the hooks 92 to inside of side rod to hook the connecting ball 92 up. Finally, tightly holding and pressing down the assembling tool 9 to push the connecting ball 32 in the lantern ring of the bungee cord 31, the connecting ball 32 can slid in the lantern ring of the bungee cord 31 by itself. The assembling tool 9 can overcome the elasticity of the bungee cord 31 to assemble the jumping mat 2, the elastic rope 3 and the side rod 11 together conveniently and swiftly.

The above descriptions are some embodiments of the application. It should be indicated that a person having ordinary skills in a relevant technical field will be able to make improvements and modifications within the spirit of the principle of the invention. The improvements and modifications should also be incorporated in the scope of the claims attached below.

What is claimed is:

1. A bounding table, comprising: a supporting frame, a jumping mat and a plurality of elastic ropes; wherein the supporting frame is annular, and the jumping mat is located at a center of the supporting frame, and a periphery of the jump mat is connected to the supporting frame by the elastic ropes;

the jumping mat comprise a plurality of rings, and the rings are evenly arranged along the periphery of the jumping mat;

each elastic rope comprises a bungee cord and a connecting ball, wherein the bungee cord is bent and both ends of the bungee cord are tied together in a knot, so that the bungee cord forms a lantern ring; the connecting ball defines a through hole, the bungee cord bifilarly passes through the through hole and the connecting ball is limited at the knot of the bungee cord; and the bungee cord bifilarly passes through the ring of the jumping mat and is connected to the supporting frame such that the bungee cord is connected between the supporting frame and the ring.

2. The bounding table according to claim 1, wherein the bungee cord hitches around the supporting frame, and the lantern ring formed by the bungee cord hooks around the connecting ball; or the supporting frame passes through the lantern ring formed by the bungee cord.

3. The bounding table according to claim 1, wherein the knot of the bungee cord is located in the through hole of the connecting ball, a flange of the connecting ball is used to confine the knot in the through hole is on an inner wall of the through hole; the flange is an annulus along a circumferential direction of the through hole.

4. The bounding table according to claim 1, wherein the bungee cord is made from natural rubber.

5. The bounding table according to claim 1, wherein the supporting frame comprises a plurality of side rods which are connected head to tail in sequence to form a ring structure, and the bungee cords hitch on the side rods; each side rod is an arc-shaped section and is formed by bending a circular tube, and ends of two adjacent side rods are joined to each other and are fixed by a bolt.

6. The bounding table according to claim 5, wherein the supporting frame is equipped with a plurality of standing legs which are arranged along a circumferential direction of the supporting frame; each standing leg is arranged perpendicularly relative to the supporting frame, and a top of the standing leg is welded to the supporting frame.

7. The bounding table according to claim 5, the standing leg and the side rod are welded together correspondingly, and there is a one-to-one correspondence between the standing legs and the side rods.

8. The bounding table according to claim 1, wherein the bounding table further comprises a single-pole armrest frame, which comprises a stand pipe, a regulating rod, an armrest and a lock screw; the stand pipe and the supporting frame are fixedly connected together; a top of the regulating rod and the armrest are fixedly connected, and the regulating rod is adjustably located inside the stand pipe in order to adjust a height of the armrest; the lock screw penetrates an inner wall of the stand pipe through a threaded hole, and one end of the lock screw connects the regulating rod to fasten the relative positions between the regulating rod and the stand pipe.

9. The bounding table according to claim 8, wherein the top of the regulating rod bends towards an inner side of the supporting frame.

* * * * *